US007153560B2

(12) United States Patent
Hofmann

(10) Patent No.: US 7,153,560 B2
(45) Date of Patent: Dec. 26, 2006

(54) DAMPING ELEMENT FOR A SHOE

(75) Inventor: Theodor Hofmann, Schluesselfeld (DE)

(73) Assignee: Puma Aktiengesellschaft Rudolf Dassler Sport, Herzogenaurach (DE)

( * ) Notice: Subject to any disclaimer, the term of this patent is extended or adjusted under 35 U.S.C. 154(b) by 67 days.

(21) Appl. No.: 10/513,087

(22) PCT Filed: Apr. 15, 2003

(86) PCT No.: PCT/DE03/01272

§ 371 (c)(1),
(2), (4) Date: Nov. 1, 2004

(87) PCT Pub. No.: WO03/092423

PCT Pub. Date: Nov. 13, 2003

(65) Prior Publication Data

US 2005/0252037 A1 Nov. 17, 2005

(30) Foreign Application Priority Data

May 1, 2002 (DE) ..... 202 06 927 U

(51) Int. Cl.
*B32B 1/00* (2006.01)
*B32B 3/00* (2006.01)
*F16M 13/00* (2006.01)
*A43B 13/20* (2006.01)

(52) U.S. Cl. ..... 428/178; 428/72; 428/116; 428/118; 248/619; 248/632; 248/634; 36/29; 36/35 B

(58) Field of Classification Search ..... 428/72, 428/116, 118, 178, 212; 248/619, 632, 634; 36/28, 29, 352, 358, 37
See application file for complete search history.

(56) References Cited

U.S. PATENT DOCUMENTS 3,608,215 A 9/1971 Fukuoka
4,521,979 A 6/1985 Blaser
4,616,431 A 10/1986 Dassier
5,815,950 A * 10/1998 Wang ..... 36/29
5,915,819 A 6/1999 Gooding
6,571,490 B1 6/2003 Tawney et al.

FOREIGN PATENT DOCUMENTS

| | | |
|---|---|---|
| DE | 89 04 649.4 | 9/1990 |
| DE | 91 06 223.3 | 11/1991 |
| DE | 91 06 224.1 | 11/1991 |
| DE | 91 06 226.8 | 11/1991 |
| EP | 0 387 505 | 9/1990 |

(Continued)

*Primary Examiner*—Donald J. Loney
(74) *Attorney, Agent, or Firm*—David S. Safran

(57) ABSTRACT

A damping element for a shoe, especially for a sports shoe, having at least one first element which extends essentially in a load direction over a pre-determined height in the unloaded state of the damping element, and is embodied as a hollow body defining a receiving area in which an associated second element with a smaller cross-section can at least partially penetrate. The second element extends essentially in the load direction over a pre-determined height in the unloaded state of the damping element, and is arranged coaxially in relation to the first element. To improve the damping performance of the shoe, the second element is also embodied as a hollow body and the two associated elements are interconnected by means of an elastic connecting section which only extends between the first-element and the second element so that the elements together form a gas-tight chamber.

25 Claims, 6 Drawing Sheets

FOREIGN PATENT DOCUMENTS

WO WO 90/12518 11/1990

WO WO 99/35928 7/1999

* cited by examiner

DAMPING ELEMENT FOR A SHOE

BACKGROUND OF THE INVENTION

1. Field of Invention

The invention relates to a damping element for a shoe, in particular for a sports shoe having at least one first element which essentially extends over a predetermined height in a loading direction in the unloaded state of the damping element and is a hollow body with a receiving space into which a corresponding second element of smaller dimensions in cross-section than the first element can at least partly penetrate, the second element essentially extending over a predetermined height in the loading direction in the unloaded state of the damping element and being arranged coaxially with the first element.

2. Description of Related Art

A shoe is known from European Patent Application EP 0 387 505 B1 which is provided with a shoe sole which already has good damping characteristics. To optimize the damping characteristics and the restoring force of the shoe sole after the load thereon has been removed, provision is made there for the shoe to be provided with a shoe sole with at least one insert part formed of a honeycomb body made of elastic compressible material, with the central axes of the gas-filled honeycomb cells running approximately perpendicularly to the plane of the sole. The honeycomb body is embodied as a molded part with definitive dimensions, the honeycomb cells at the circumference or edge of the honeycomb body being sealed gas-tight.

With such a damping element in the form of a honeycomb body, it is already possible to give the shoe good damping characteristics and significantly increase the restoring force of the shoe sole and hence the recovery of energy after the pressure on it has been released. However, a further increase in these parameters is desirable.

German Patent Application DE 33 38 556 A1 and corresponding U.S. Pat. No. 4,616,431 also disclose a damping element for a sports shoe of the kind described. The sole is provided with cylindrical recesses into which replaceable damping discs can be placed, and of a piston which is associated with each cylinder and engages in the respective cylinder and presses on the damping discs.

SUMMARY OF THE INVENTION

Therefore, the underlying object of the invention is to develop a damping element of the kind named initially such that the damping characteristics of the shoe are improved further. In particular, the object is to increase the restoring force of the sole of the shoe after the pressure on it has been released so that the energy recovery when the pressure on the shoe is released can be increased even further.

The way in which this object is achieved by the invention is the two associated elements are connected to one another through an elastic connecting portion which only extends between the first element and the second element, the elements being facing hollow members that together form a gas-tight chamber.

Therefore, the damping element according to the invention is designed in the manner of a telescopic damper. The first element functions as a cylinder-like receiving chamber into which the second element can penetrate in the manner of a piston. Thus, a high spring travel can be achieved and the spring and damping characteristics of the shoe can be adjusted to the required conditions. In addition, it is also possible to recover a considerable amount of the energy expended during the compression of the damping element.

According to a first development of the invention, provision is made for the first element and the second element to have a corresponding form in a section perpendicular to the loading direction. This should be taken to mean that the cross-sectional geometry of the first element and the cross-sectional geometry of the second element are embodied congruent to one another so that a matching receiving and inlet space is created in the first element for the second element.

Preferably, the first element and the second element have a polygonal, in particular hexagonal, shape in a section perpendicular to the loading direction. In this case, the damping element is embodied in the manner of a honeycomb pattern. However, other geometrical arrangements are possible; for example, the first element and the second element can exhibit a circular shape in a section perpendicular to the loading direction.

The dimensions of the first element in a section perpendicular to the loading direction are preferably greater than the corresponding dimensions of the second element. This makes it advantageously possible for the second element to enter the space defined by the first element.

Advantageously, in the unloaded state of the damping element, the first element is located with its axial extension essentially outside the axial extension of the second element. This should be taken to mean that in the unloaded state of the damping element the piston-like second element is arranged axially outside the cylinder-like first element. The "piston" only enters the "cylinder" when the damping element is laden in the loading direction.

In addition, provision can be made for the first element and the second element to be embodied as hollow bodies which are connected to one another through a connecting portion. In the unloaded state of the damping element, the connecting portion can run flat in a plane perpendicular to the loading direction. However, provision can also equally be made for the connecting portion to run in a curve in the unloaded state of the damping element. The last-named variant makes it easier for the "piston" to enter the "cylinder". This is also the case when the connecting portion is made of elastic material, as is provided according to a further development of the invention.

Both functional and technical manufacturing advantages can be obtained when the first element, the connecting portion and the second element are embodied in one piece. Here, provision can be made in particular for the first element and the second element to be manufactured by an injection molding process. It is favorable when the first element, the connecting portion and the second element are manufactured by a common injection molding process.

To attain a high level of damping and energy recovery from the damping element according to the invention, provision can be made for the elements to form gas-tight chambers. For this, it is advantageous that the end of the first element remote from the second element is connected to a sealing film. Likewise, the end of the second element remote from the first element can also be connected to a sealing film. The respective element and the sealing films can be connected to one another in a gas-tight fashion, in particular welded. The result with such an embodiment can be that the first element, the second element, the connecting portion and the sealing films form a gas-tight sealed flexible chamber. This influences the manner of operation of the sealing element according to the invention in a particularly advantageous fashion.

The elements can be made of plastic, in particular of a thermoplastic material. Polyethylene, polypropylene, polybutane, polyamide, polyurethane or a mixture of at least two of these plastic materials have proved themselves to be suitable materials. In addition, the plastic can be translucent or transparent.

A plurality of first and/or second elements can be combined with one another or arranged next to one another to form a sufficiently large damping element which covers the desired areas of a shoe, in particular a sports shoe.

According to one embodiment, the first elements are connected to one another at their sides. Such an embodiment can be produced particularly easily with a geometry according to a honeycomb pattern.

In the case that a plurality of first and second elements are arranged next to one another, provision can be made for the connecting portion of at least two adjoining first or second elements to be embodied as a common part. It is also possible for the plurality of first and second elements arranged next to one another to be connected to one another through the connecting portions. A further development provides for the first and second elements to be arranged a distance from and parallel with one another.

The adjustment of the damping element to the concrete requirements in terms of geometry and function is made easier in that provision can also be made for the first and/or second elements to exhibit different heights at least in part in the unloaded state of the damping element.

The damping characteristics and the ability of the damping element to absorb and return energy can be influenced by the choice of the parameters which determine the geometry and the material properties. Therefore, preferably, provision is also made for the material of the first element, the second element and the connecting portion, and the geometric dimensions of the named parts to be chosen to determine the stiffness of the damping element.

The proposal according to the invention creates a damping element which, to a great degree, increases the damping and the restoring force of the shoe sole and hence the recovery of energy after the pressure on the shoe sole is released. In addition, the proposed embodiments mean that the damping element according to the invention can be produced advantageously from the technical manufacturing point of view and thus inexpensively.

Embodiments of the invention are shown in the drawings by way of example and are explained in detail below.

DETAILED DESCRIPTION OF THE INVENTION

Figure 1:
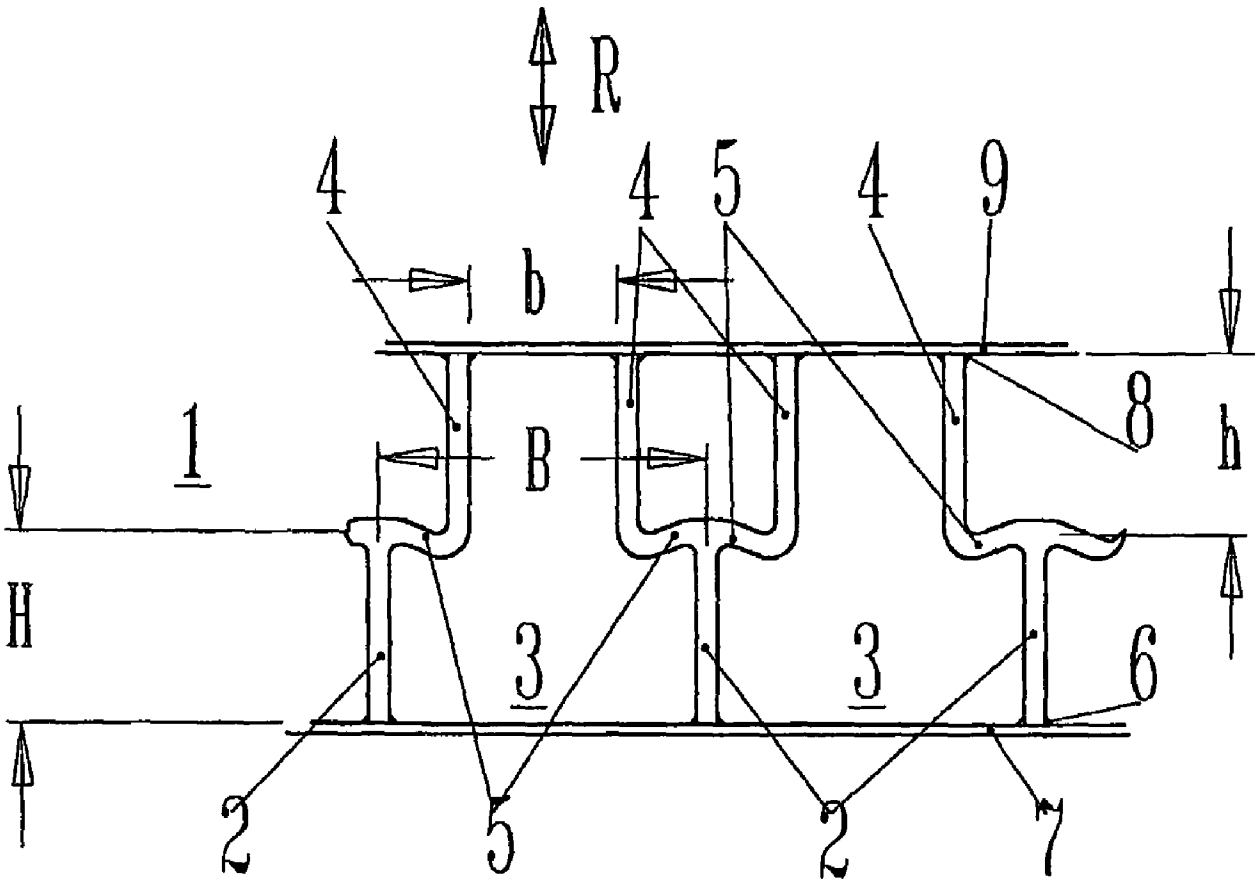
FIG. 1 is a diagrammatic side view of a damping element in section.

FIG. 1 shows a damping element 1 in section. The damping element 1 is incorporated in a shoe (not shown) in particular in the sole of the sports shoe, for example, in the manners shown for the damping units of U.S. Pat. Nos. 4,616,431; 5,152,081 and 5,915,819. The damping element 1 serves to absorb energy when the sole is placed under load in the loading direction R and to give off the energy stored in the damping element 1 again when the load on the sole is released.

Figure 2:
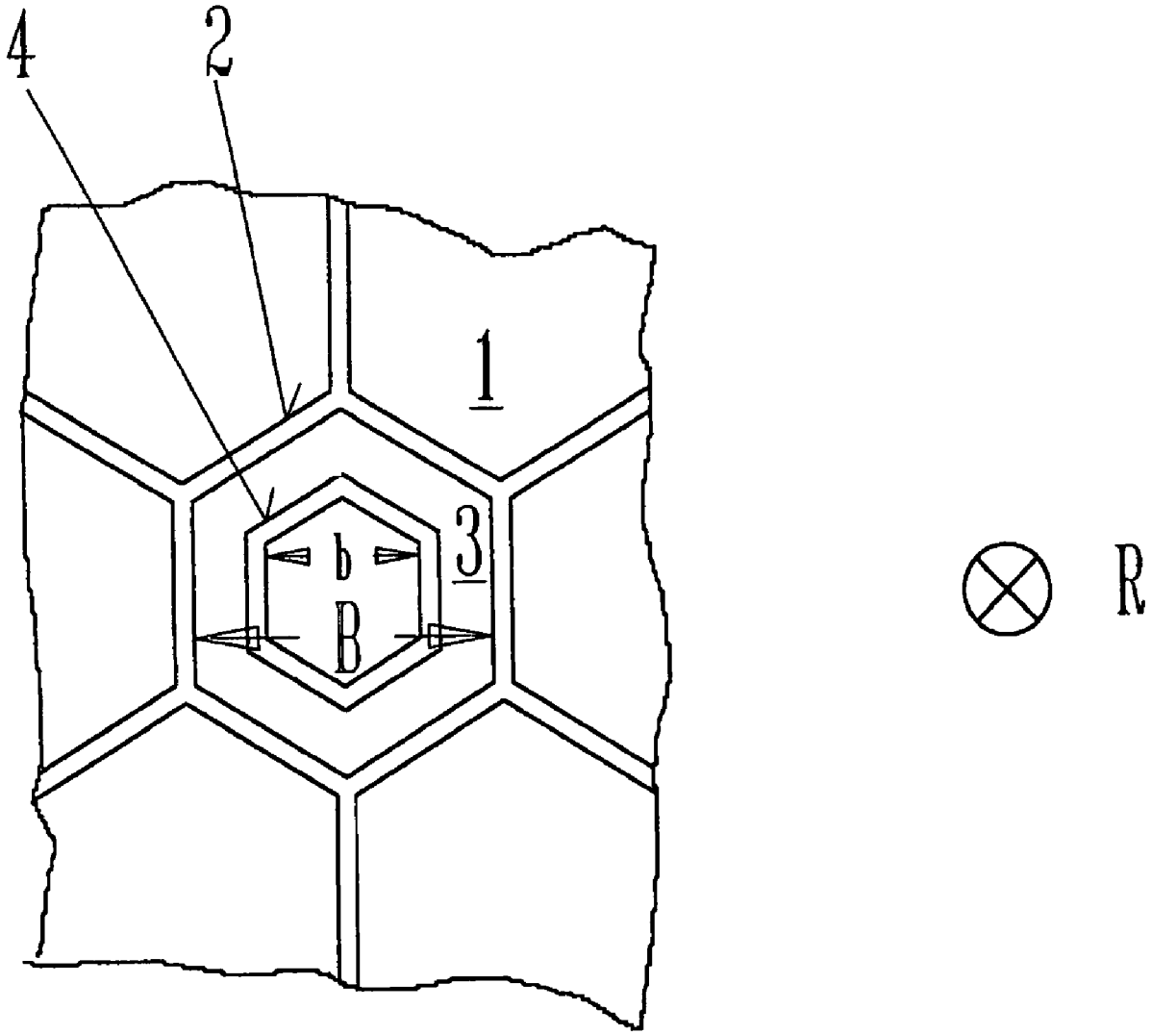
FIG. 2 is a diagrammatic plan view of the damping element according to FIG. 1.

As can be seen in conjunction with FIG. 2, the damping element 1 exhibits a first element 2 and a second element 4 which are embodied hexagonally in the manner of a honeycomb pattern. The first element 2 exhibits a receiving space 3 which results from the space contained in the hexagonal body. In FIG. 1, the length of the first element 2 in the loading direction R is indicated by H (height of the first element 2 in the unloaded state of the damping element 1). The second element 4, which extends over an axial height h in the loading direction R, is arranged axially above the first element 2 in the unloaded state of the damping element 1. As can be seen in particular from FIG. 2, the dimensions—breadth B of the first element 2 and breadth b of the second element 4—are chosen so that, when the damping element 1 is placed under load in the loading direction R, the second element 4 can enter the receiving space 3 which is defined by the first element 2. Accordingly, the first element 2 and the second element 4 work in the manner of a telescopic damper, with the first element 2 functioning as the "cylinder" into which the second element 4 can enter in the manner of a "piston".

For this telescopic damping effect to be able to take place while achieving a restoring effect when the pressure on the damping element 1 is released, the upper axial end area of the first element 2 and the axial lower end area of the second element 4 are connected to one another through a connecting portion 5 as shown in FIG. 1. The connecting portion 5, like the first and second elements 2, 4, is as a part made of an elastic plastic material so that, when a loading force is applied to the damping element 1 in the loading direction R, a deformation takes place, as illustrated diagrammatically in FIG. 3 by which the second element 4 enters the receiving space 3 of the first element 2 in the manner of a piston.

To ensure restoration of the FIG. 1 starting state after the pressure on the damping element 1 is released, not only is the connecting portion 5 made elastic, but the measures indicated below are also taken.

The end 6 of the first element 2 that is remote from the second element 4 (lower end in FIG. 1) is connected to a first sealing film 7, in particular welded thereto. In the same way, the end 8 of the second element 4 remote from the first element 2 (top end in FIG. 1) is provided with a second sealing film 9. The sealing film 9 is also connected, preferably welded, to the second element 4. Thus, the first element 2, the second element 4, the connecting portion 5 and the two sealing films 7, 9 form a gas-tight sealed space which exhibits optimum spring and damping properties.

Figure 3:
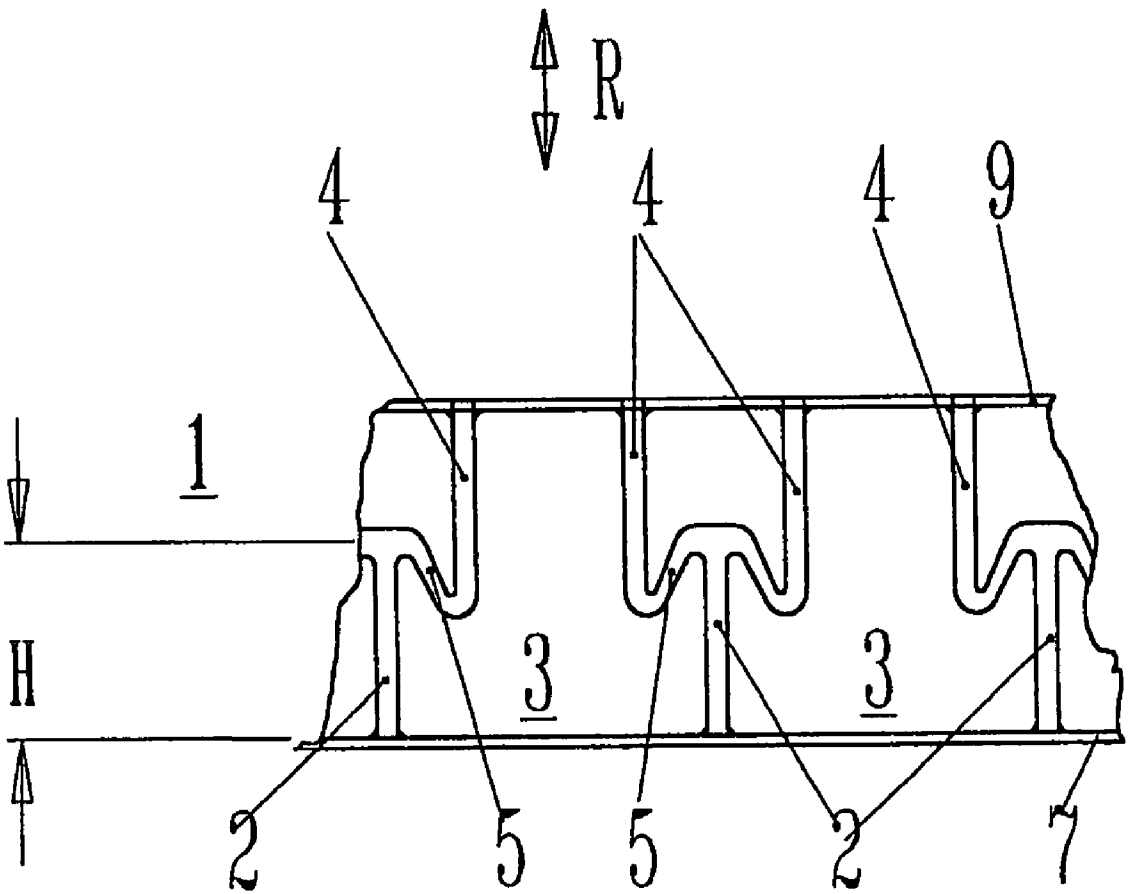
FIG. 3 is an illustration corresponding to FIG. 1 in which the damping element is shown in a deformed state.
Figure 4:
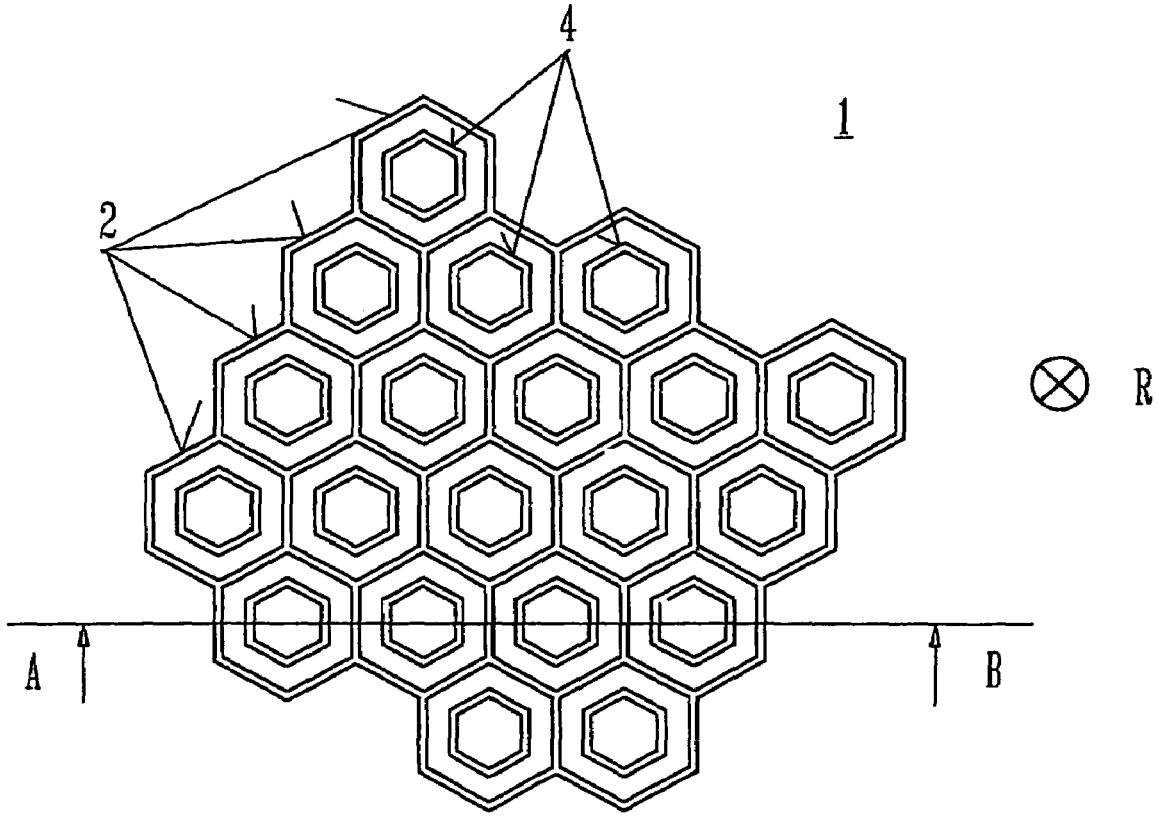
FIG. 4 shows a damping element made of a number of individual elements in a plan view.
Figure 5:
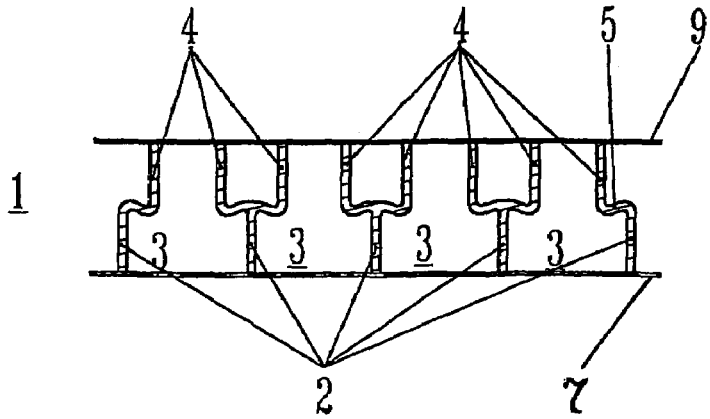
FIG. 5 is the sectional view taken along line A–B in FIG. 4.

Individual "piston and cylinder elements", formed of the components 2, 4, 5, 7 and 9, as illustrated in FIGS. 1 to 3, can be arranged next to one another—as can be seen in FIGS. 4 & 5—to form a damping element 1 which will extend over a greater area. In particular, for this, the elements 2, 4 are preferably embodied in a hexagonal form or in the manner of a honeycomb pattern.

Figure 6A:
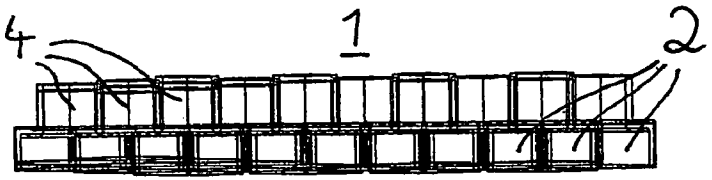
FIG. 6*a* is an elevational view of a damping element made of a number of individual elements.
Figure 6B:
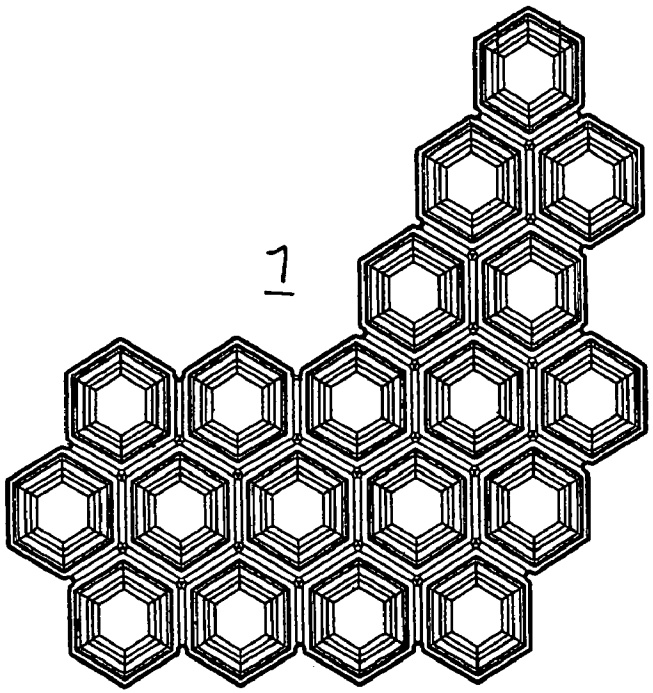
FIG. 6*b* is a plan view of the damping element shown in FIG. 6*a;*
Figure 6C:
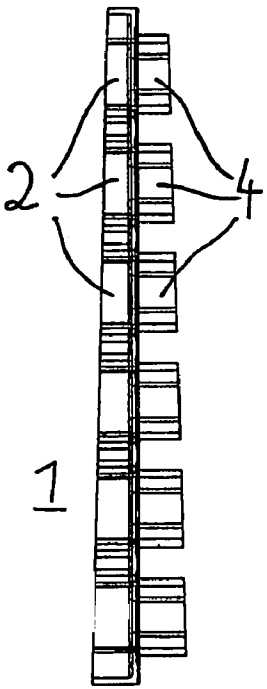
FIG. 6*c* is a view of the damping element as seen from the lateral side in FIG. 6*a*.

While the lower honeycomb elements 2 functioning as "cylinders" are connected to one another according to FIG. 5, the upper "pistons" formed by elements 4 stand freely next to one another (as shown in FIG. 6*c*) and are only connected to one another by the sealing film 9. The connection between the "cylinders" cylinders formed by elements 2 and the "pistons" formed by elements 4 is effected through the connecting portions 5 which are curved as can be seen in FIG. 5. This makes it easier for the "pistons" formed by elements 4 to go into the "cylinders" formed by elements 2 when a loading force is applied in the loading direction R.

The entire damping element 1 illustrated in FIG. 4—appropriately trimmed—can be introduced into a shoe and in particular into an intermediate sole (midsole) thereof.

When the damping element 1 is under load, the "pistons" formed by elements 4 are pressed into the "cylinders" formed by elements 2 since the connecting portions 5 lying essentially horizontal are not as stiff as the cell walls of the first or second elements 2, 4 standing essentially perpendicular.

As the force increases, the second elements 4 are pressed more and more into the axial area of the first elements 2.

Thus, a counteracting force corresponding to the load on the damping element 1 is obtained until the "pistons" formed by the second elements 4 are pressed fully into the "cylinders" formed by the first elements 2.

When the pressure on the damping element 1 is released, the original geometry is restored to that shown in FIGS. 1 & 5.

The following should also be noted in connection with the arrangement of the sealing films 7, 9. In the embodiment according to FIGS. 1 to 5, the sealing film 7, 9 extends over a number of the "piston and cylinder elements" arranged next to one another, i.e., a film 7, 9 covers a number of such elements. However, as an alternative to this, provision can be made for only individual film portions to be used which, in each case, provide a gas-tight seal for one end 6 of just one first element 2 and/or one end 9 of just one second element 4. Then, these film portions form a "lid" which closes the end areas of the elements 2, 4. This "lid" can be welded to the ends 6, 8 of the elements 2, 4 respectively; however, it is also possible for it to be injection molded, for example, during the injection molding of the elements 2 and 4, i.e., molded in situ with them. Preferably, provision is made for the ends 6 of the first elements 2 to be sealed with a co-extensive film 7 (as illustrated in FIG. 1), while the ends 8 of the second elements 4 are only sealed with individual film portions 9 in the form of "lids."

An alternative embodiment of the damping element can be seen in FIGS. 6*a*, 6*b*, 6*c* and 7. Here, provision is made for a plurality of first and second elements 2, 4 to be arranged next to one another, the first and second elements 2, 4, respectively, being positioned a distance from and parallel with one another (illustrated without the films 7 or 9, see FIG. 1). That is, unlike the embodiment of FIGS. 1–5, adjacent elements do not share a common side wall.

The connection of the individual units, in each case formed of a first and a second element 2, 4, respectively, is effected through the connecting portions 5 which also connect the first and the second elements 2, 4 to one another. Thus, the connecting portions 5 not only produce the connection between the first and the second element 2, 4 in the axial direction, but also the connection between the individual part elements to form the structure as a whole which is illustrated FIGS. 6*a*, 6*b*, 6*c* and 7.

Figure 7:
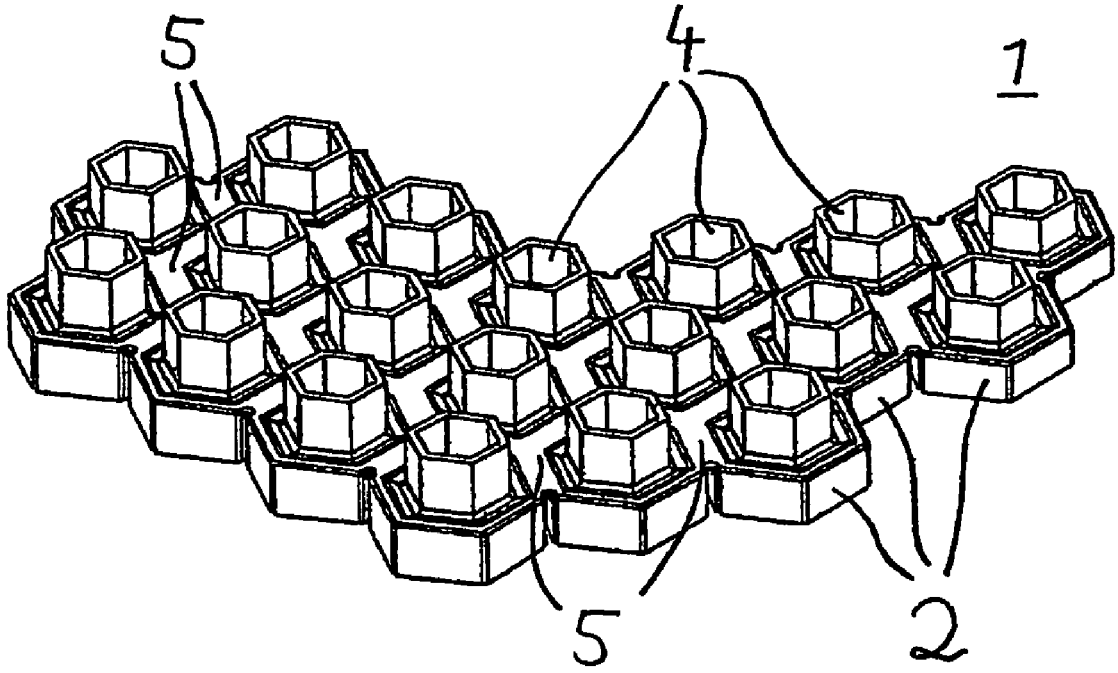
FIG. 7 shows the damping element according to FIGS. 6*a*, 6*b* and 6*c* in a perspective view.

As can be seen above all in FIGS. 6*c* & 7, provision is made here for the first and second elements 2, 4 to have different heights H and h, respectively, at least in part, in the unloaded state of the damping element illustrated. Thus, as can be seen in FIG. 6*c*, the elements 2, 4 at one edge are shorter than those at the opposite edge.

The spring and damping characteristics of the damping element 1 can be adjusted or selected as required by adjusting the geometry, and here in particular, these heights and the breadths of the individual elements 2, 4, the thickness and shape of the connecting portions 5 and by corresponding selection of the material from which these parts are made.

Thus, the spring and damping characteristics of the damping element 1—in particular the spring force over the spring travel—can be largely chosen according to a desired pattern. This makes it possible to influence the individual function which must be performed by the individual part damping element formed of the first element, second element and connecting portion, i.e., according to whether a supporting or a damping effect is required.

The damping element 1 according to the invention can also be used in a shoe, in particular a sports shoe, in combination with a conventional damping element as known in the state of the art. This gives further possibilities allowing optimum adjustment of the spring and damping characteristics of a shoe, in particular a sports shoe, to the particular requirements.

What is claimed is:

1. Damping element for a shoe, comprising:

at least one first element having a predetermined height in a loading direction in an unloaded state; and a corresponding second element having smaller cross-sectional dimensions than the first element and having a predetermined height in said loading direction in an unloaded state;

wherein said at least one first element has a hollow body that defines a receiving space that is at least partly penetrated by the second element in a loaded state, wherein the second element is substantially located outside the first element with respect to the loading direction in the unloaded state, wherein the second element has a hollow body and is arranged coaxially with respect to the first element;

wherein the first and second elements are connected to one another by an elastic connecting portion which only extends between the first element and the second element, and wherein the connected first and second elements, together, form a gas-tight chamber.

2. Damping element according to claim 1, wherein the first element and the second element have a corresponding cross-sectional shape in a plane perpendicular to a loading direction in use in a shoe sole.

3. Damping element according to claim 1, wherein the first element and the second element have a polygonal cross-sectional shape in a plane perpendicular to a loading direction in use in a shoe sole.

4. Damping element according to claim 1, wherein the first element and the second element have a circular cross-sectional shape in a plane perpendicular to a loading direction in use in a shoe sole.

5. Damping element according to claim 1, wherein, in the unloaded state of the damping element, the connecting portion extends flat in a plane perpendicular to a loading direction in use in a shoe sole.

6. Damping element according to claim 1, wherein, in the unloaded state of the damping element, the connecting portion runs in a curve in a plane perpendicular to a loading direction in use in a shoe sole.

7. Damping element according to claim 1, wherein the first element, the connecting portion and the second element are formed of a one-piece construction.

8. Damping element according to claim 7, wherein the first element and the second element are formed of an injection mold part.

9. Damping element according to claim 1, wherein an end of the first element that is remote from the second element is connected to a sealing film.

10. Damping element according to claim 1, wherein an end of the second element that is remote from the first element is connected to a sealing film.

11. Damping element according to claim 10, wherein an end of the first element that is remote from the second element is connected to a sealing film; and wherein the elements and the sealing films are connected to one another in a gas-tight manner.

12. Damping element according to claim 11, wherein the first element, the second element, the connecting portion and the sealing films form a gas-tight sealed, flexible chamber.

13. Damping element according to claim 1, wherein the elements are made of plastic.

14. Damping element according to claim 13, wherein said plastic is a plastic material selected from the group consisting of polyethylene, polypropylene, polybutane, polyamide, polyurethane and a mixture of at least two of said plastic materials.

15. Damping element according to claim 13, wherein the plastic material is translucent or transparent.

16. Damping element according to claim 1, wherein a plurality of first elements are connected to one another.

17. Damping element according to claim 16, wherein a plurality of second elements are connected to one another.

18. Damping element according to claim 16, wherein the first elements are connected to one another at adjacent sides thereof.

19. Damping element according to claim 1, wherein a plurality of second elements are connected to one another.

20. Damping element according to claim 17, wherein the connecting portion of at least two adjoining elements is formed as a part that is common to the at least two adjoining elements.

21. Damping element according to claim 20, wherein the plurality of first and second elements arranged next to one another are connected to one another by the connecting portions.

22. Damping element according to claim 17, wherein the first and second elements arc arranged a distance from and parallel with one another.

23. Damping element according to claim 17, wherein at least some of at least one of the plurality first elements and the plurality of second elements have heights which are different in the unloaded state.

24. Damping element according to claim 1, wherein the material of the first element, the second element and the connecting portion, and the geometric dimensions of the first element, the second element and the connecting portion have been selected to produce predetermined damping properties.

25. Damping element for a shoe, comprising:

a plurality of laterally interconnected first elements having a predetermined height in a loading direction in an unloaded state, each of the first elements laterally adjoining a plurality of other first elements and sharing a common vertical wall portion with each of said other first elements; and a plurality of corresponding second elements having smaller cross-sectional dimensions than the first elements and having a predetermined height in said loading direction in an unloaded state;

wherein each of said first elements has a hollow body that defines a receiving space that is at least partly penetrated by a respective one of the second elements in a loaded state, wherein each of the second elements has a hollow body and is arranged coaxially with respect to the respective first element;

wherein the first and second elements are connected to one another by an elastic connecting portion which only extends between the vertical wall pardons of the respective first element and the second element, and wherein the connected first and second elements, together, form a gas-tight chamber.

* * * * *